US005690594A

United States Patent [19]

Mankovitz

[11] Patent Number: 5,690,594

[45] Date of Patent: Nov. 25, 1997

[54] EXERCISE APPARATUS FOR USE WITH CONVENTIONAL CHAIRS

[76] Inventor: Roy J. Mankovitz, 18057 Medley Dr., Encino, Calif. 91316

[21] Appl. No.: 441,940

[22] Filed: May 16, 1995

[51] Int. Cl.[6] ..... A63B 21/02

[52] U.S. Cl. ..... 482/121; 482/132; 482/130; 482/129

[58] Field of Search ..... 482/121, 130, 482/83, 135, 79, 129, 132

[56] References Cited

U.S. PATENT DOCUMENTS

| | | | |
|---|---|---|---|
| 3,130,968 | 4/1964 | De Feen . | |
| 3,421,760 | 1/1969 | Freeman | 482/121 |
| 3,672,670 | 6/1972 | Burzenski . | |
| 3,707,284 | 12/1972 | Waldeck | 482/130 |
| 3,712,613 | 1/1973 | Feather et al. | 272/58 |
| 3,738,649 | 6/1973 | Miller | 272/58 |
| 3,743,282 | 7/1973 | Zinkin | 272/58 |
| 3,768,808 | 10/1973 | Passerra | 272/80 |
| 3,942,791 | 3/1976 | Dawson et al. | 272/31 |
| 4,149,714 | 4/1979 | Lambert et al. | 272/118 |
| 4,225,132 | 9/1980 | Archambault . | |
| 4,685,671 | 8/1987 | Hagerman et al. | 272/139 |
| 4,913,423 | 4/1990 | Farran et al. | 272/134 |
| 4,936,573 | 6/1990 | Miller | 272/131 |
| 4,946,162 | 8/1990 | Lubie . | |
| 5,002,271 | 3/1991 | Gonzales | 272/134 |
| 5,044,633 | 9/1991 | Rice | 272/144 |
| 5,171,295 | 12/1992 | Schwalm, Jr. | 482/131 |
| 5,183,450 | 2/1993 | Stelmach | 482/83 |
| 5,234,394 | 8/1993 | Wilkinson | 482/92 |
| 5,242,354 | 9/1993 | Seith, Jr. | 482/130 |
| 5,260,870 | 11/1993 | Tsuchiya et al. . | |
| 5,324,243 | 6/1994 | Wilkinson | 482/92 |
| 5,364,326 | 11/1994 | Smith et al. | 482/113 |
| 5,431,617 | 7/1995 | Rattrag, Jr. | 482/121 |
| 5,499,961 | 3/1996 | Mattox | 482/132 |

FOREIGN PATENT DOCUMENTS

| | | | |
|---|---|---|---|
| 1206495 | 6/1986 | Canada | 482/79 |
| 0117960 | 10/1969 | Norway | 482/129 |

*Primary Examiner*—Jerome Donnelly
*Attorney, Agent, or Firm*—Christie, Parker & Hale, LLP

[57] ABSTRACT

Exercise apparatus for attachment to a conventional office chair of either the swivel or multiple leg type having a plurality of resilient members attached to the chair with a chain or other conventional means and attached to a foot support bar which can be pushed away from the chair by an occupant of the chair, stretching the resilient members and thereby exercising the occupant.

23 Claims, 15 Drawing Sheets

10

79
80
81
79
82
83
42
26
86
84
83
42

18
16
24
100
102
103
44
42

10
79
80
81
79
111
112
110
42
113
42

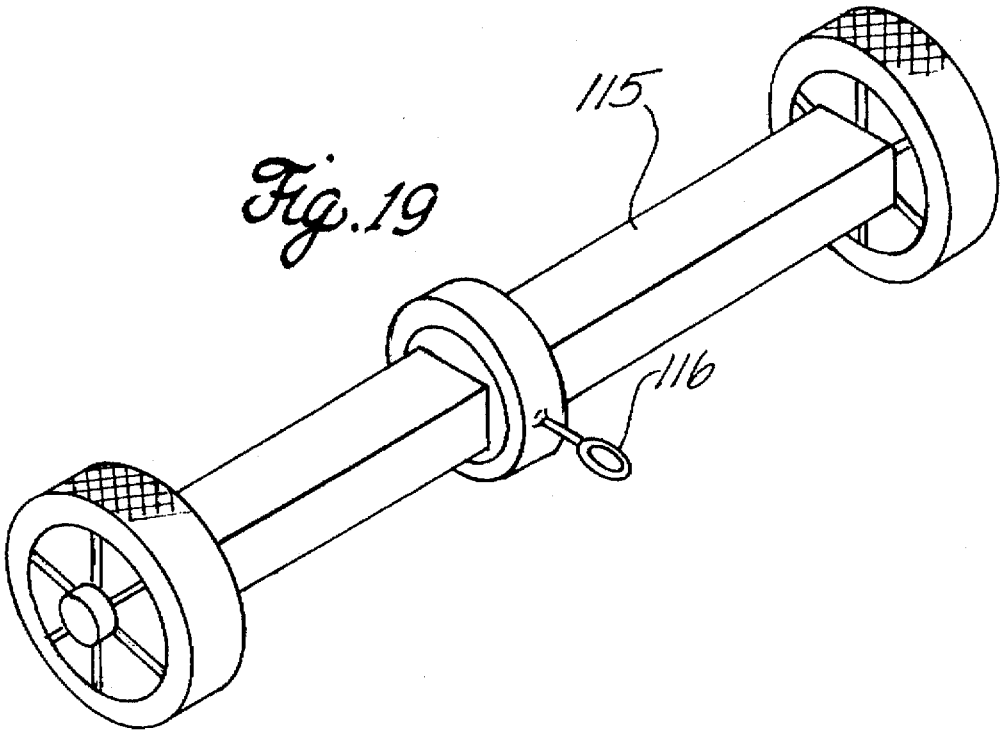
Fig. 19
Fig. 20
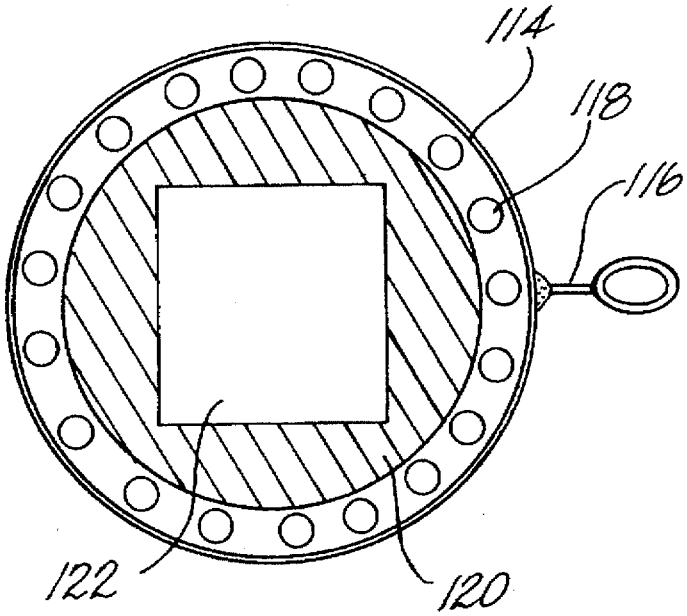

EXERCISE APPARATUS FOR USE WITH CONVENTIONAL CHAIRS

BACKGROUND OF THE INVENTION

This invention relates to exercise apparatus.

Recent studies have shown that the body has a weight set point which makes it extremely difficult to lose weight and keep it off. It is believed that the only way to accomplish this is to reduce calories 15% below what would normally be required to maintain the desired weight, or to increase physical activity. Most persons attempt to increase activity rather than decrease caloric intake or attempt some combination of the two. However, modern living has made it more and more difficult for persons to obtain adequate levels of physical activity. With leisure time being limited, it becomes difficult or impossible for most persons to utilize gymnasium facilities.

As a result of the realization of the need for and increasing interest in exercise, a wide variety of exercise machines have been developed for commercial and home use with a goal to efficiently use all available exercise time. Among the various exercise devices are a number of different general types or classes of equipment that have been designed in order to respond to the variety of different exercise needs, differences in the personnel using the equipment, and different theories as to exercising techniques themselves. One such general type of exercise apparatus incorporates some weight or force generating elements rather than requiring separate free weights to be used with the device. Typically, such exercise machine-type apparatus incorporate a floor standing frame on which levers, cables, springs, or the like are mounted and which are coupled to weight elements, springs, hydraulic cylinders and the like, in order to resist movement. Handles, pads, foot straps and the like are secured to the lever or cable so that the user may, for example, grasp the handle and push the lever against the resisting force. Such machine-type exercise equipment had been developed from various different exercises and therefore this type of equipment incorporates benches, seats, platforms, and the like on which the user sits, lies or stands during use depending on the particular exercise to be performed.

Although exercise equipment such as free-weight devices or exercise machine-type apparatus are generally effective for providing the intended exercise, these pieces of equipment are normally relative large, space-consuming apparatus that are both expensive and unsightly. Heretofore, such exercise machines have typically been used in gyms or kept by a private owner in a separate exercise area because of the unsightly appearance of such equipment and because of its sole function as a piece of exercising equipment. Because the exercising equipment is kept in a separate room, a user is to some degree precluded from performing other activities unrelated to exercising while using the exercise equipment. While using the equipment, the user is isolated from other persons not exercising and is also removed from normal living and work areas where the user could contemporaneously perform other activities such as watch television, read a book, work on a computer, revise a paper, or the like.

Another problem associated with prior exercise machines is the relative expense, particularly in view of the limited amount of time that any given individual uses such a piece of equipment. For this reason, many individuals prefer to join commercial athletic or health clubs having a number of such exercise machines, rather than attempting to purchase these bulky and expensive pieces of equipment themselves. Thus, the usual exercise time is limited to less than one hour, and in the case of many office workers, the exercise time is gained only at the sacrifice of lunch time. For such a short exercise time to have any appreciable impact, high levels of force and long distance must be exerted. These high levels of force or distance become tiring and usually lead to abandonment of any regular routine. Therefore, the constraints of modern work schedules necessitate the utilization of any available time for exercise to reduce levels of force and distance.

An office worker often has short periods of time in which to perform exercises, such as when talking on a speaker phone and waiting for a called party to come to the phone. It would be desirable if office workers could perform exercises during these brief periods of time while seated in an office chair. It would be further desirable if office workers could continue exercising during typical office tasks such as working on the computer, opening mail, revising papers, or the like. However, in order for such office exercise apparatus to gain acceptance, it must not interfere with the comfortable seating of office workers at a desk and movement in a desk area by swiveling in a seat or moving a chair on a desk pad. Further, the apparatus must be usable under a desk or computer table to allow continuous exercising throughout the workday. Though the art has provided apparatus having some degree of functionality, these devices require the legs to be extended horizontally, and thus, they cannot be used under desks because the toes hit the bottom of the desk before full extension or the feet contact the back of the desk before full extension.

Thus, utilizing the free time available in the office or home for exercise and continuing to exercise during certain office tasks is desirable to enhance the health and morale at and away from the office. Increases in the health and morale of the office workers translate into many intangible benefits including happier more productive office workers.

BRIEF SUMMARY OF THE INVENTION

One embodiment of the invention is an exercise apparatus for attachment to a conventional chair with at least one support member. A foot support, for receiving the foot of a person sitting in the chair, is smoothly guided along a plane away from and toward the chair. A resilient member is for coupling between the foot support and the chair and resists the forced movement of the foot support away from the chair and retracts the foot support toward the chair when the force pushing the support away from the chair is decreased.

In alternate embodiment of the invention multiple resilient members are used for coupling between the chair and foot support to increase the required force. Preferably, the apparatus further includes a retraction resilient member which acts on the foot support to retract it to a storage position under the chair.

Advantages of this invention will appear from the following description of the preferred embodiments and the accompanying drawings in which similar reference characters denote similar elements throughout the several views.

BRIEF DESCRIPTION OF THE DRAWINGS

FIG. 19 is a perspective view of the foot support assembly illustrating the attachment of a single exercising resilient member to the foot support assembly with a bearing assembly;

FIG. 20 is a side view of the bearing assembly of FIG. 19;

DETAILED DESCRIPTION

Figure 1:
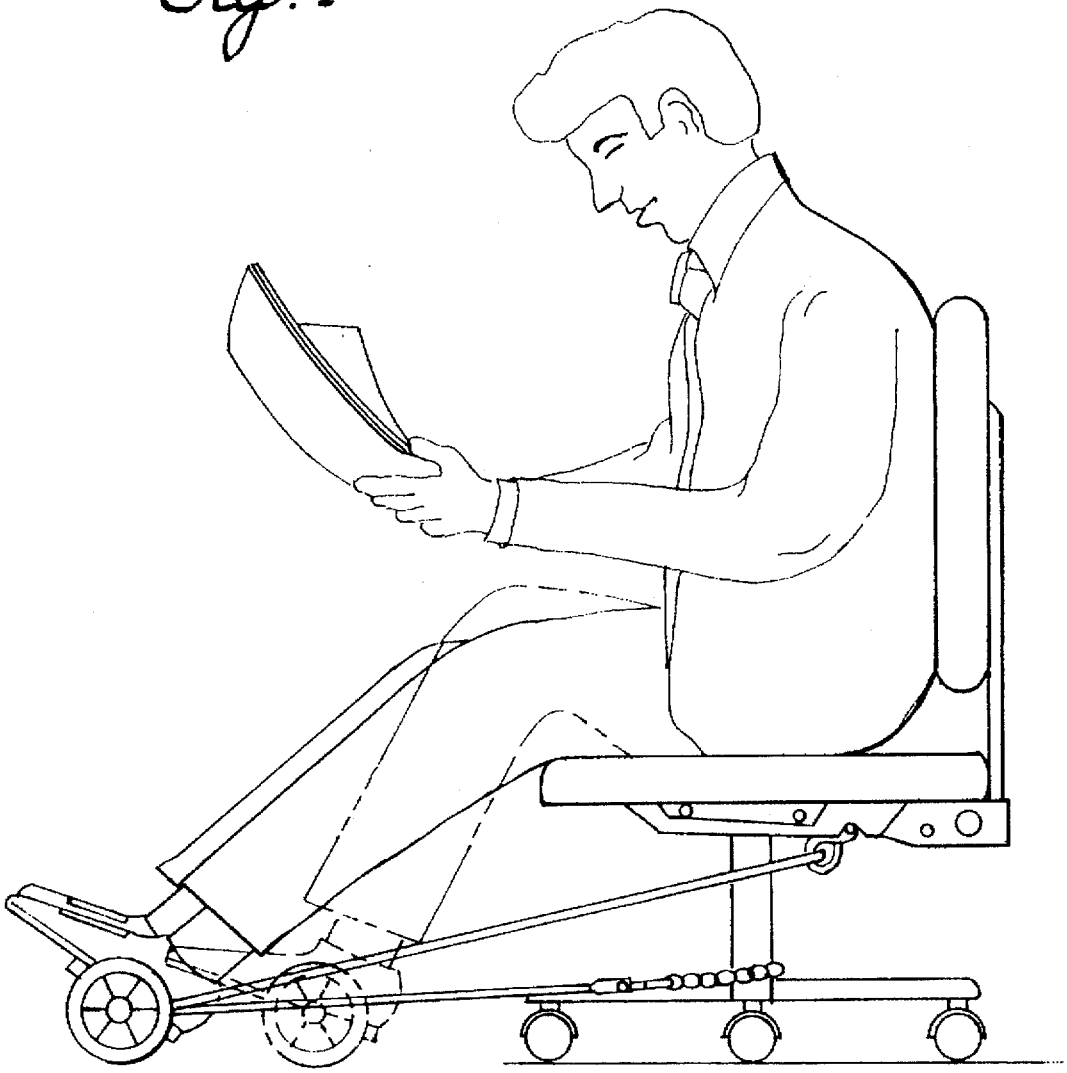
FIG. 1 is a side view of exercise apparatus according to the present invention attached to a swivel chair with central support and illustrating the use of the apparatus.

Turning to the drawings, FIG. 1 shows a conventional office chair 10, with a central support post 12. The exercise apparatus, generally designated 14, is attached to the chair and placed in a position in front of chair occupant 11, allowing the occupant to place his or her feet on the foot support or footrest 26 of the exercise apparatus to exercise. To exercise, the occupant repeatedly straightens and bends his or her legs translating the apparatus away from the chair, against the resisting force on foot support 26 by the exercising resilient members 22 to the position shown in solid lines and back toward the chair to the position shown in phantom lines.

Figures 2, 3, 4:
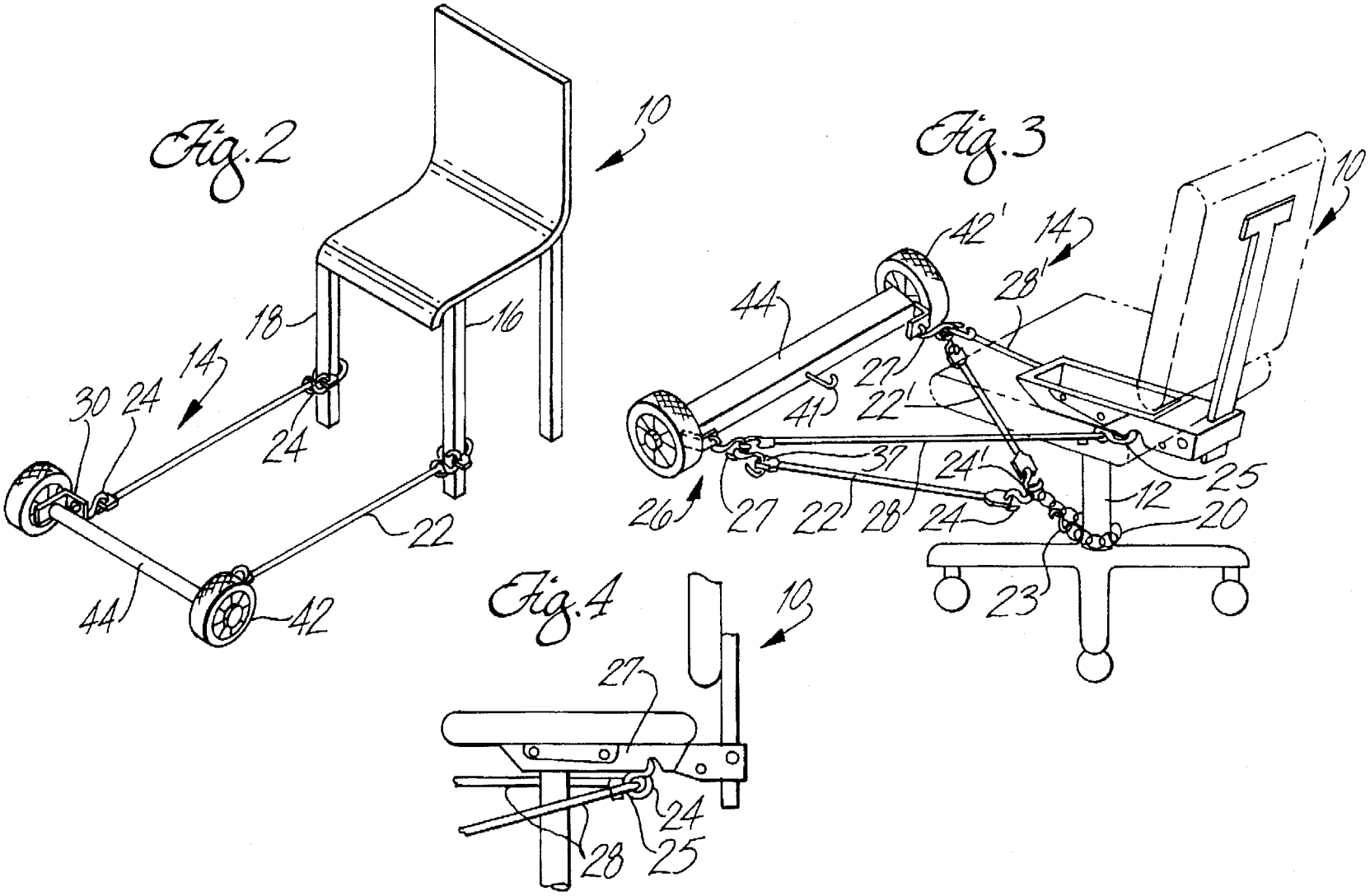
FIG. 2 is a perspective view of alternate exercise apparatus according to the present invention attached to a multiple leg chair.
FIG. 3 is a perspective view of the exercise apparatus of FIG. 1 showing the seat and back of the chair in phantom.
FIG. 4 is a partial side view of a swivel chair and the exercise apparatus of FIG. 1 illustrating an alternate connection of retraction resilient members to the chair.

The exercise apparatus according to the present invention is attachable to any conventional office chair. For the swivel chair 10, the exercise apparatus is attached into central support post 12. For multiple leg chairs as shown in FIG. 2, an alternate exercise apparatus according to the present invention is connected to the chair legs. One way to obtain the proper positioning of the exercising apparatus when a multiple leg chair is used, is to attach the exercise apparatus to the two front legs 16 and 18 of the chair as in FIG. 2 or the rear two legs as in FIG. 15.

Referring to FIGS. 1, 3 and 4, one embodiment of the exercise apparatus is shown attached to chain 20. The chain is wrapped around the central support post and is linked back to itself with the quick link 23. Any of many conventional means available may be used in place of quick limb 23 for connecting the chain back on itself such as the well known lap link, S-hook or snap link.

Exercise resilient members 22 and 22' connect the foot support assembly 26 to the post 12 via chain 20, to this end S-hooks 24 and 24' are connected between ends of exercise resilient members 22 and 22', respectively, and the end of chain 20 opposite from the end connected to quick link 23, as seen in FIG. 3. Exercising resilient members 22 and 22' are rubber straps with ends having connecting apertures. Other elastic cords may be used. The preferred rubber straps are manufactured by Keeper Corp. in Willimantic, Conn. and are ordered by referencing part number 06215.

Exercise resilient members 22, 22' have aperture 37, 37' respectively through which one end of the S-hooks 24, 24' respectively are inserted. The connection between the holes on the rubber straps and the S-hooks is held by friction because of the diameter of the holes 37, 37' are slightly smaller than the diameter of the S-hooks.

To obtain balance throughout the length of the foot support assembly 26, one exercise resilient member is connected to each end of the foot support assembly 26 equal distance from the center of the foot support assembly. To increase the force required by the user to move foot support 26 away from the chair, additional exercise resilient members are added in parallel with each of exercise resilient members 22, 22' as shown for member 22' at 22" in FIG. 6 (the connection will be discussed below), the chain 20 is adjusted to bring the foot support apparatus 26 closer to the chair, or the exercise resilient members are replaced with less elastic resilient members. It is preferred that an even number of exercise resilient members be used to maintain a balanced force along the length of the foot support assembly 26.

Figure 10:
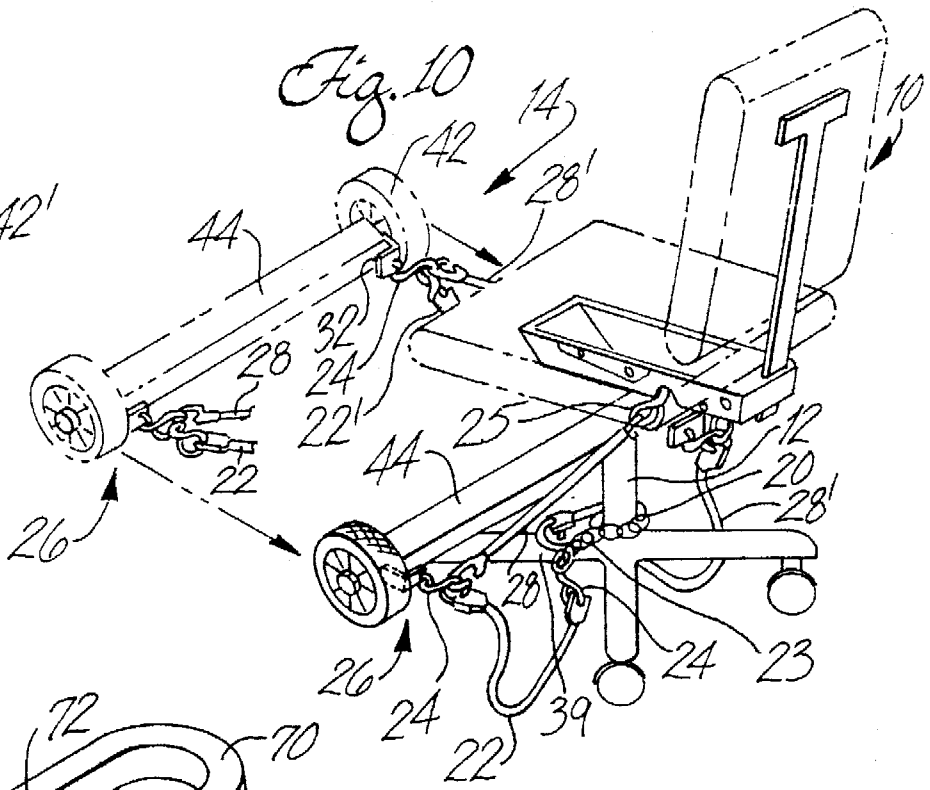
FIG. 10 is a perspective view of the exercise apparatus of FIG. 1 illustrating the apparatus in a non-operative, retracted position.
Figure 10A:
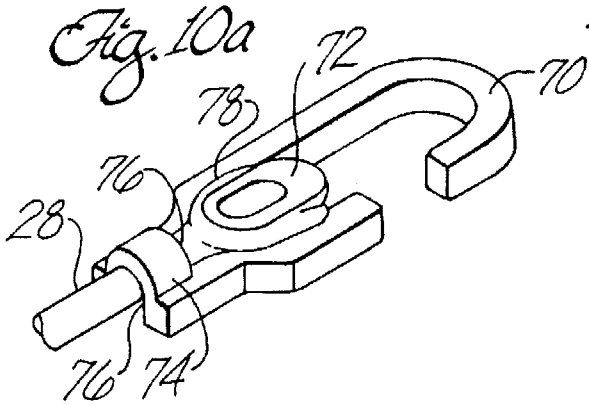
FIG. 10*a* is a perspective view of the hook used on the retraction resilient members.
Figure 9:
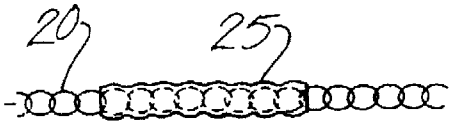
FIG. 9 is an elevational view of a coated chain.

When the apparatus is not in use, retraction resilient members 28, 28' retract the foot support assembly 26 into a non-operative position as shown in FIG. 10. As shown in FIG. 10*a* for retraction resilient member 28', each end of each resilient retraction member is affixed to a connector including a hook 70, pin 72, and holding bracket 74 with an aperture 76 therethrough. Each end of each retraction resilient member has a loop 78 which is inserted through the aperture 76 and looped around the pin 72. The elastic properties of the retraction resilient member are chosen so that it extends and deforms with far less applied force than the exercising resilient members. Thus, each retraction resilient member has a greater ability to deform with less resistive force than the exercising resilience members. The more elastic retraction resilient members each have an unstretched length short enough, so that when the user's foot is removed, they retract the foot support assembly 26 to a position underneath the chair and, when the user extends the foot support, they can be stretched long enough to allow full extension of the occupant's legs. Because ends of the retraction resilient members 28, 28' are attached by S-hooks 25, 25' (25' not being shown), respectively, to a higher point on the chair than the exercising resilient members, the retraction resilient members retract the foot support assembly to a non-operative position underneath the chair on top of the legs 39 as shown in FIG. 10. Connection assembly can then be returned to the exercise position simply by placing a foot thereon and sliding the assembly onto the floor. Because the retraction resilient members are easily deformed, it is easy to slide the assembly into the active position, and it is not necessary to grasp the assembly to place it on the floor before setting the foot thereon. Further, retracting the apparatus underneath the chair onto the top of the legs prevents the occupant and others from tripping over the apparatus, and allows the occupant to freely move and swivel the chair. Also, the attachment of the retraction resilient members to a high point on the chair exerts a downward force on the chair as the assembly is pushed away from the chair. The downward force tends to stabilize the chair and prevent the front of the chair from lifting off the floor.

Because the retraction resilient members have a far greater ability to deform, they also serve a safety function. If one of the exercise resilient members should break or an S-hook become loosened, the retraction resilient members will prevent the foot support apparatus from being pushed across the room by the occupant. In an alternate method for storing the apparatus, a hook 41 shown in FIG. 3 is attached to the center of the support bar 44. The support assembly is locked into the nonoperative position by hooking the hook 41 onto a link of the chain 20 that is close to the support post or legs of the chair. This alternate means for storage requires an extra step to exercise or store the apparatus in the safest place, but still keeps the apparatus readily available for exercise. S-hooks 25, 25' or other type of hooks are attachable to any of the abundant locations on a swivel chair which are capable of receiving and holding a hook. One such location is an aperture in the support structure for the chair as in FIG. 3 and another is an eye hook in flange 27 as shown in FIG. 4. The flange or a similar member is found on almost all swivel chairs.

Figures 5, 6, 7:
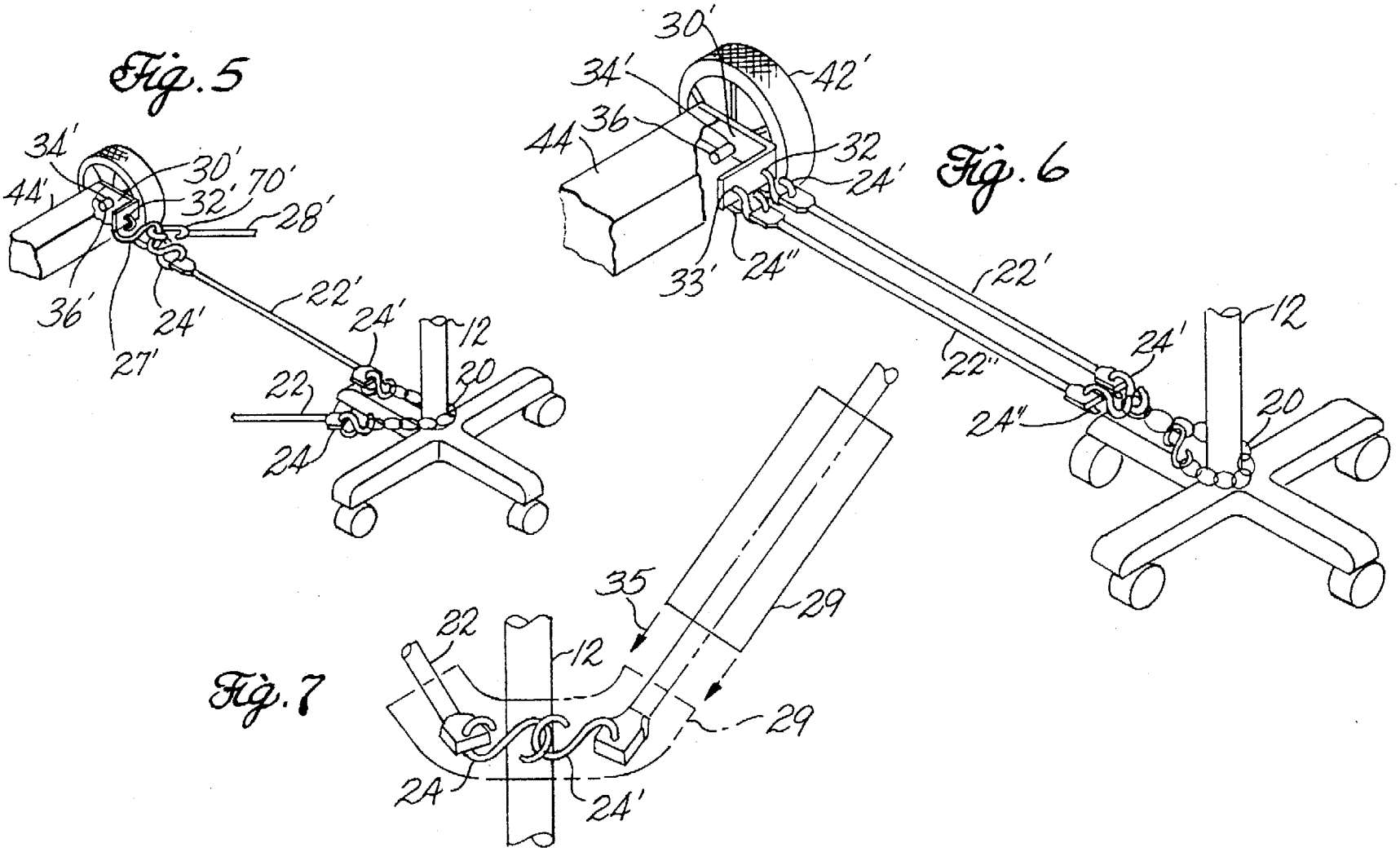
FIG. 5 is a partial perspective view of the exercise apparatus of FIG. 1 illustrating the connection between the resilient members and the foot support assembly and an alternate connection to the chair post.
FIG. 6 is a partial perspective view of the exercise apparatus of FIG. 1 illustrating the connection of multiple exercise resilient member on one side and an alternate connection to the chair.
FIG. 7 is a partial rear view of the exercise apparatus of FIG. 1 illustrating an alternate connection to the chair post.
Figure 8:
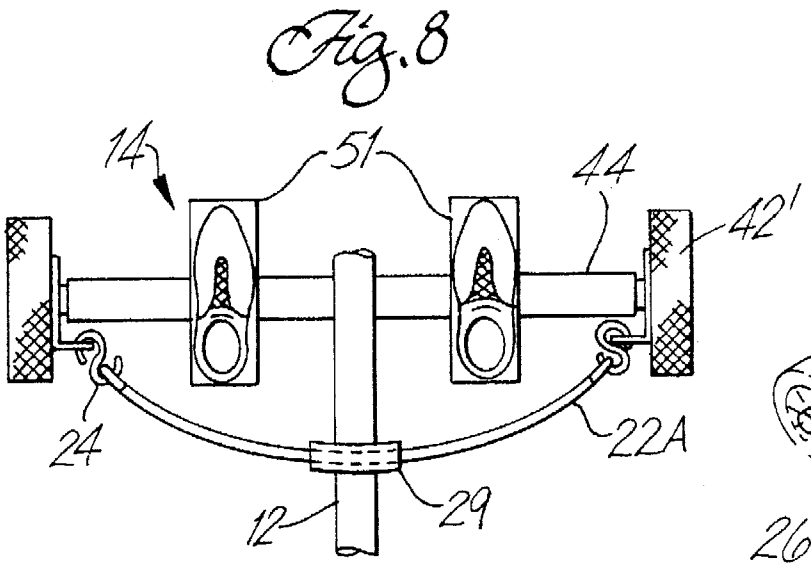
FIG. 8 is a rear view of the exercise apparatus of illustrating a still further alternate connection to the chair and illustrating sole plates added to the foot support apparatus.

As shown in FIG. 5 the exercise apparatus is also attached to the chair by wrapping the chain 20 behind the center post of the chair, and attaching each end of the chain to an end of a different one of the two exercise resilient members by S-hooks 24, 24'. Further, the exercise resilient members are also attachable directly to the center support post 12, as shown in FIG. 7, by hooking them together with S-hooks 24 and 24' at the back side of the support post, or as shown in FIG. 8 using one long exercise resilient member 22A wrapped around support post 12 with each end thereof connected by a separate S-hook 24 to a different end of the foot support apparatus 14.

To attach the foot support apparatus 26 to the multiple leg chair shown in FIG. 2, each exercising resilient member 22, 22' of FIGS. 1 and 3 is directly attached by being wrapped around one of the two front legs and hooked back onto itself with the corresponding S-hooks 24, 24', respectively. A separate chain can be connected to each S-hook 24, 24' and attached to each leg of the chair. Direct connection of the exercise resilient members is preferred because the rubber grips the legs, preventing the members form sliding to the floor.

To prevent any of the S-hooks from disconnecting they may be bent closed after they are connected.

It is desirable that the exercise apparatus leave no dents or marks on the chair. Therefore, the chain 20 and/or S-hooks may be covered or coated with a non-marring protective plastic 25. Alternatively, as in FIGS. 7 and 8, a protective sleeve 29 is used. After the S-hooks 24, 24' are connected, the sleeve slides over the S-hooks as illustrated by arrows 35 to the position of the sleeve shown in phantom lines covering the S-hooks. The long resilient member 22A is wrapped behind the post 12 and the sleeve 29 is adjusted so that it contacts the support post, thereby preventing the chair from being damaged.

All of the methods of connection to the chair do not require modifying the chair in any way and allow for easy interchangeability between chairs. However, the chain is preferred because it provides a large range of adjustment for the position of the foot support apparatus relative to the chair, and the adjustment can be made in a short period of time. The position is adjusted by linking the chain back into itself at different links. Thus, the position of the foot support apparatus can be adjusted to accommodate the various leg lengths and strengths of different users. Though a chain or resilient member linked to itself after it is wrapped behind a chair leg or support is illustrated as the means of connection, other conventional means of attaching the exercise apparatus to the chair are contemplated within the scope of the present invention.

Refer now to FIG. 5 and consider the connection for the exercise resilient, members 22, 22' to the foot support assembly 26, for the embodiment of FIGS. 1, 2 and 3. The parts to be explained in FIG. 5 are on the right side and have corresponding essentially identical parts (not shown) on the left side (not shown) of the foot support apparatus 26. Primes are affixed to the members to indicate the parts on the right side whereas unprimed numbers are used for the corresponding parts on the right side. Exercise resilient member 22' is attached to the foot support assembly with L-bracket 30' or other means for attachment, including the S-hooks. The L-bracket has a first aperture 32' through which one end of S-hook 27' is inserted. The resilient members 22', 28' having S-hooks 29' and 70', 24, 24' respectively, attached to the support assembly by hooking the S-hooks to S-hooks 27' as shown in FIG. 5.

An additional exercise resilient member 22" is attached to the L-bracket as shown in FIG. 6. Either the aperture 32' is made large enough to receive a plurality of S-hooks 24' or 70', or other apertures such as 33' are formed in the L-bracket. For example, additional exercise resilient members 22" is connected to L-bracket 34' with S-hook 24" through aperture 33'.

Figure 11:
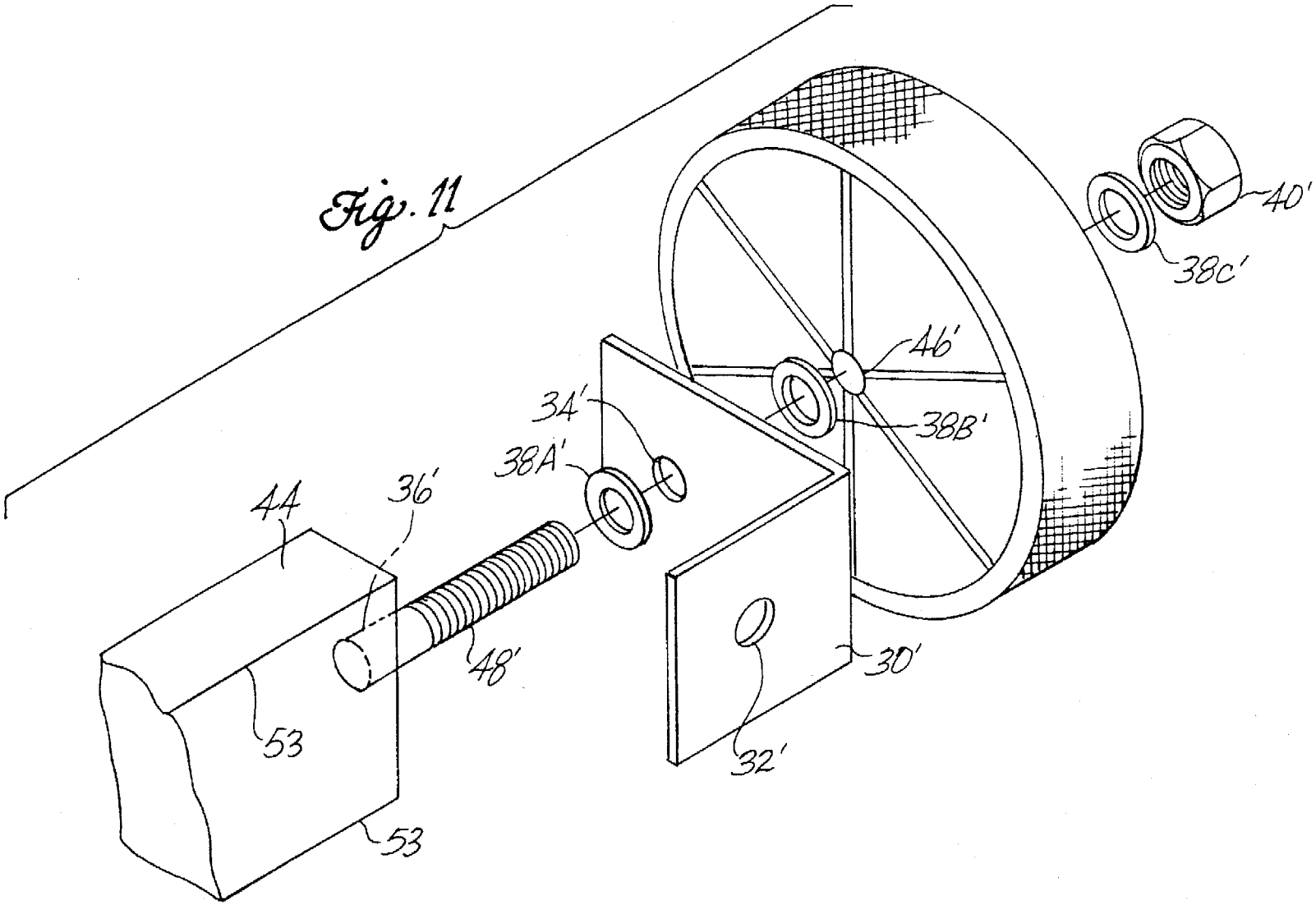
FIG. 11 is a partial exploded perspective view of the right side of the foot support apparatus of FIG. 1.

The right end of foot support assembly 26, is exploded in FIG. 11. L-bracket 30', three nylon washers 38A', 38B' and 38C', lock nut 40', axle 36' and wheel 42' connected to the right end of foot support bar 44. To prevent the heel of a shoe from scuffing on the floor, the wheel should have a diameter not less than approximately 6 inches. The axle 36' is inserted into a hole in the right end of the foot support bar 36' and washer 38A' is inserted over the axle. The L-bracket is then placed on the axle followed by washer 38B'. The wheel 42', for preferably rolling directly on a floor has a centrally located aperture 46' which is mounted around the axle. Next washer 38C' and finally lock nut 40' are mounted on the axle. The threaded portion 48' of the axle 36' extends through the wheel and washer 38C' so that the nut can be threaded onto threads on the axle 48', thereby securing the assembly. The same assembly is completed on the left side of the support bar 4. Both the L-brackets and the wheels at each end are free to independently rotate on the axle; thus, the support bar itself can rotate relative to the wheel and L-bracket.

An odometer may be added to one side for the avid exerciser.

Figure 21:
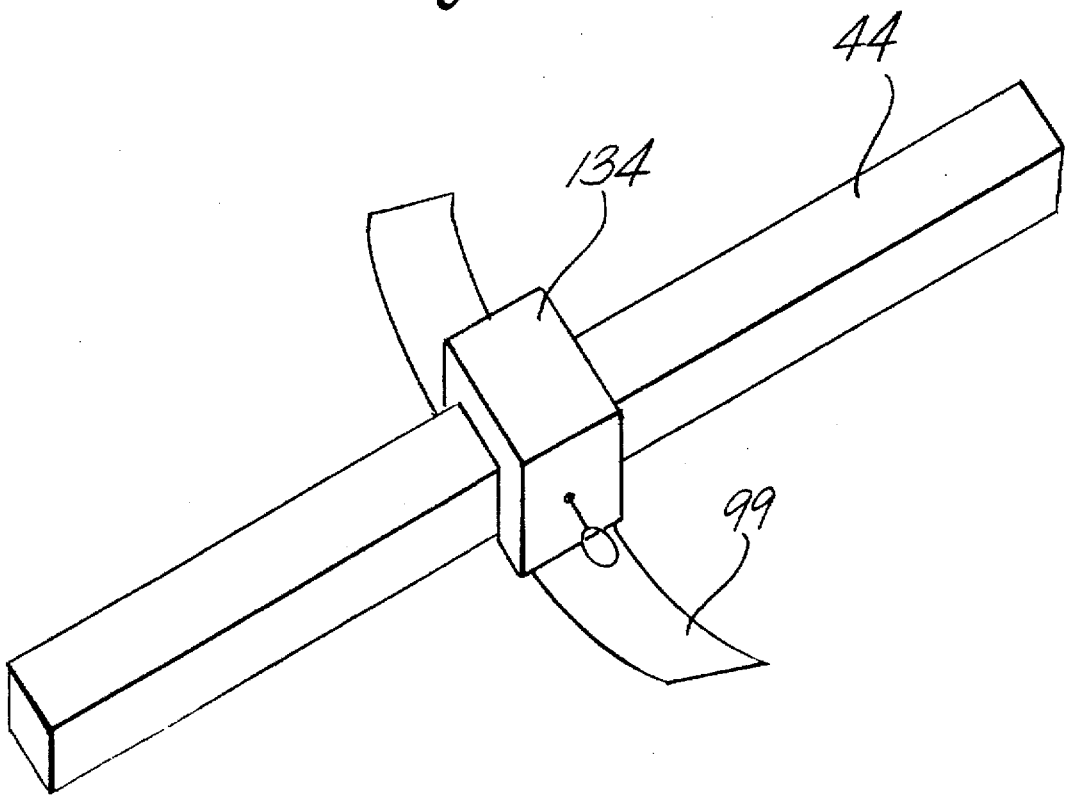
FIG. 21 is a schematic perspective view of an alternate embodiment of the foot support assembly utilizing a glide.
Figure 23:
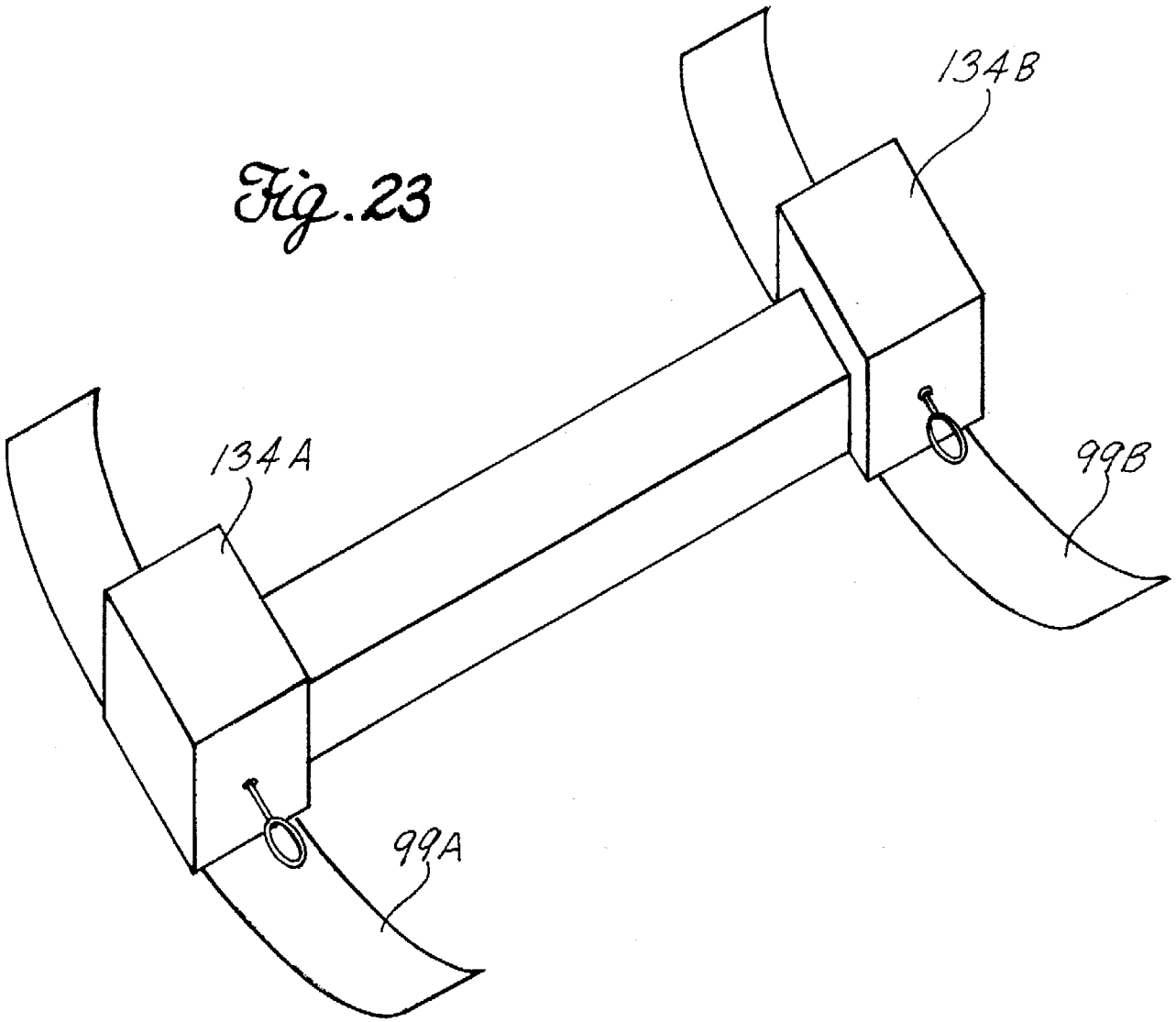
FIG. 23 is a schematic perspective view of an alternate embodiment of the foot support assembly utilizing glides and two bearing assembly connections.

Though the preferred embodiment shown and described utilizes two wheels mounted on opposite ends of the foot support bar, the invention also contemplates a single wheel centrally located at the center of bar 44. Further, the wheels may be replaced with gliders 99 which slide on the floor as shown in FIGS. 21 and 23. The glider is manufactured from or coated with nylon or other material with a low coefficient of friction, allowing it to translate smoothly over any surface, and as the support assembly is translated back and forth away from the chair, the frictional force remains nearly constant. In operation, as the support assembly 26 is translated away from the chair, the force exerted by the occupant increases, but the angle between the user's legs and the floor decreases, thus, the normal force and hence the frictional force remain nearly constant. Each end of the glider is turned upward like the downhill tip of a ski, allowing the glider to translate over carpet and transitions between floor surfaces where there is a ledge. Therefore, all of these means for translating the foot support assembly allow the apparatus to translate on a wide variety of surfaces and transitions between surfaces.

The foot support bar 44 is rectangular or square in cross section made from aluminum or wood, and in one preferred embodiment is 18 inches long and 2 inches square. Other dimensions can be used without departing from the inventive concept. The bar can also have a triangular or circular cross-section, but it is desirable to provide an edge 53 (FIG. 3) against which the heel of a shoe can lock. Other shapes of bars'such as L-shaped can also be used to provide the desired edge.

Referring to FIG. 8, sole plates 51 may be rigidly fastened at the same distance on either side of the center of the foot support bar 44 each large enough to support the entire foot. The sole plates are slidably mounted onto the bar, allowing the occupant to adjust the sole plates to a comfortable lateral position.

Figure 12:
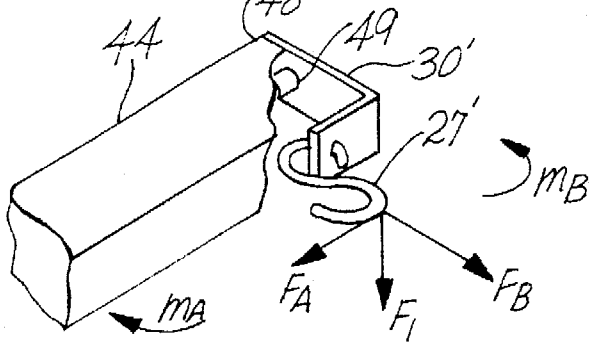
FIG. 12 is a schematic illustration of the force on the L-bracket and the resulting moments on the foot support apparatus of FIG. 1.

Each L-bracket is dimensioned so that it cancels out, at least in part, the moments exerted on the respective axle. Referring to FIG. 12, the exercise resilient member (not shown) exerts force $F_1$ on the S-hook 27'. Force $F_1$ can be broken down into its components $F_A$ and $F_B$. The component force $F_A$ creates the moment $M_A$ about point 49 where the L-bracket contacts the axle. The force $F_B$ creates the moment $M_B$ around point 49. The moments $M_A$ and $M_B$ are in the opposite direction and therefore tend to cancel each other out. As the support assembly is extended away from the occupant, the force $F_B$ increases and the force $F_A$ decreases, so the L-bracket is built so that the values of $M_A$ and $M_B$ are nearly equal when the support assembly is pushed farthest away from the occupant. At this point, the forces will be at their greatest, and it is, therefore, more beneficial to balance out the moments at that point. Typical dimensions of the L-bracket are 1 inch by 1.75 inch, the 1.75 inch portion being attached to the axle and the 1 inch portion extending parallel to the axle. Thus, it can be seen that a shorter moment arm is provided for the greater force $F_B$. The L-bracket extends far enough beyond the axle to allow its free rotation without contacting the support bar. However, the edges 48 may be taken off the ends or rounded to allow free rotation of the L-bracket without using an excessively long L-bracket.

Because the support bar and L-brackets are independently rotatable relative to the wheels, the angle of the bar is allowed to adjust as the occupant pushes the support assembly away, allowing the angle between the user's foot and leg to automatically vary to the most comfortable position. Thus, the occupant can remain completely seated in the chair while exercising.

It can be seen from FIG. 3 that the resilient members and the support bar form a triangle which leaves space open for the occupant to place his or her feet on the support bar without the use of any holding mechanism such as stirrups, Velcro® straps, or bindings. Thus, the occupant of the chair, in order to use the apparatus, need only place his or her feet onto the support bar. There is no need to bend over to thread the foot through a stirrup, strap the foot to a bar or cord, or clip the foot into a binder. The ease of access also allows the occupant to quickly get off the apparatus and get up from or move the chair.

The operation of the apparatus, demonstrated in FIG. 1, requires the occupant to extend his or her legs, thereby pushing the foot support apparatus away from the chair against the force of the resilient members and then oscillating the apparatus toward and away from the chair, so that the foot support apparatus rolls or glides on the floor. In the alternative, the foot support apparatus is held away from the chair without oscillation, held away from the chair with short alternating oscillations between the legs producing a rocking motion in the support bar, or held away from the chair while rotating the support bar on the axle by tilting the feet forward and back, thereby flexing the calves. Because the apparatus rolls on the floor, it may be used under a desk or computer station, allowing exercise throughout the workday. By providing a means to exercise lightly over a long period of time without interfering with other activities, a substantial benefit is provided to the modern office worker and a daily routine of exercise, not likely to be abandoned, is established.

Figure 13:
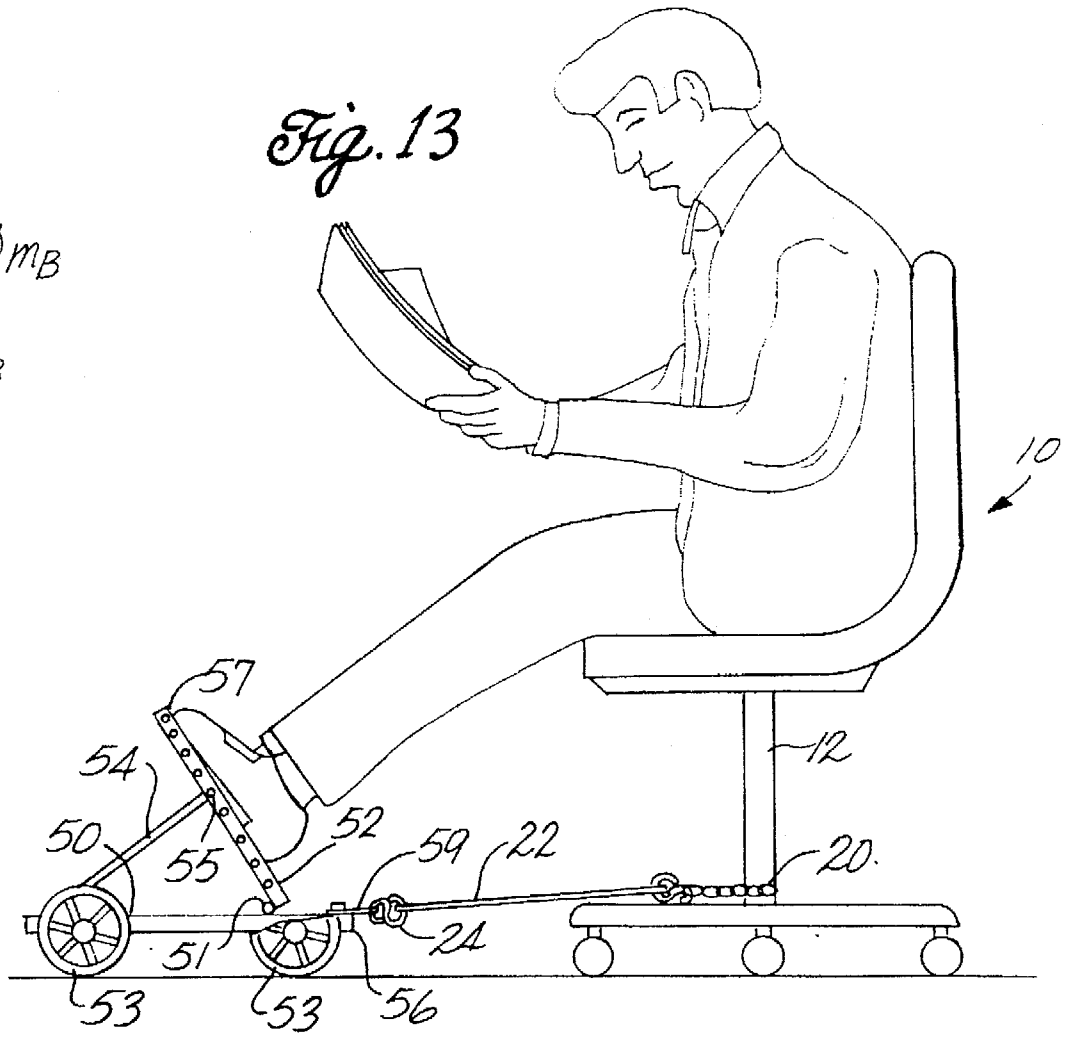
FIG. 13 is a side view of alternate exercise apparatus with an alternate foot support apparatus according to the present invention utilizing a foot platform.

An alternate embodiment shown in FIG. 13 has a foot support apparatus including, a base plate 50, which is rectangular viewed from the top, on which a rectangular foot supporting platform 52 is hingedly mounted with hinge 51. Four wheels are rotatably mounted to the upper side of plate 50, two on each side (only one side shown), allowing the plate to be moved away from and toward the user in chair 10. The wheel on the facing side on the right is broken away to expose the hinge. Adjustment dowels 54, one on each side of platform 52 (only one side shown), allow the user to pivot and adjust support platform 52 to a comfortable angle by moving the dowels so that notch 55 in the end of each dowel engages a different one of pin, 57 located along opposite edges of the support platform. Two exercising resilient members 22 (only one shown in FIG. 13) are attached to the edge of plate 56 facing the chair 10. A separate eye hook 59 is connected at spaced apart positions on edge 56 and is connected to one of the exercising resilient members by a separate S-hook 24. The exercise resilient members are again attached to the support post of the swivel chair or the legs of a multiple leg chair with a chain or other conventional means as discussed herein.

The wheels for the foot support assembly in the previously described figure form means for smoothly translating the foot support apparatus along the floor.

Figure 14:
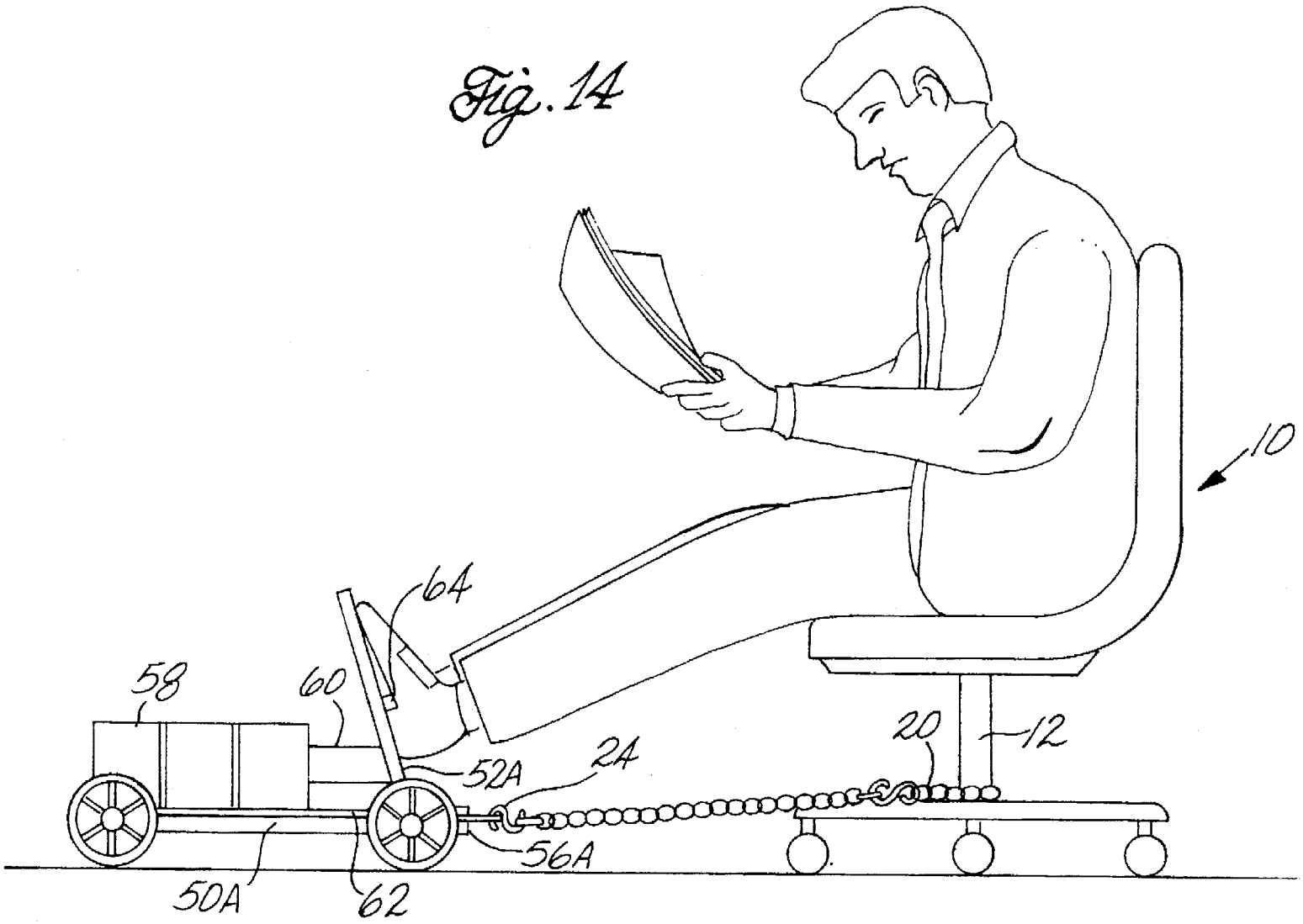
FIG. 14 is a side view of still another alternate exercise apparatus with an alternate foot support apparatus according to the present invention utilizing a piston as the resilient member and a foot platform.

Another alternate embodiment is shown in FIG. 14. This embodiment again utilizes a base 50A to which a foot supporting platform 52A is slidably mounted. A piston 58 is fixedly mounted to the base on rails 62, (one rail on each side of base plate 50K), and a piston rod 60 extends out of the piston in the at rest position. The piston rod engages the platform, so that the angle of the platform relative to the piston rod and base is adjustable. Preferably, the piston contains a spring return (not shown) and has an adjustable leak hole valve (not shown) to control the pressure required to compress the piston. As the occupant pushes on the foot support platform, the piston rod is pushed into the piston and the foot support platform slides on rails 62 which are attached to the base. When the occupant releases the pressure the spring return (not shown) returns the piston rod to the original position outside of the piston. In this embodiment, the chair side 56A of the base is attached directly to the support post of a swivel chair or legs of a multiple leg chair with a chain 20 or other rigid member. Further, the platform has a ridge 64 on which the occupant can lock the heel of a shoe. The pistons with spring returns the plate 52 and the chain 20 with connecting hooks form means for resiliently coupling foot support plate 52 to chain. The 62 form means for smoothly translating the foot support plate 52 along relative to the floor.

Figure 15:
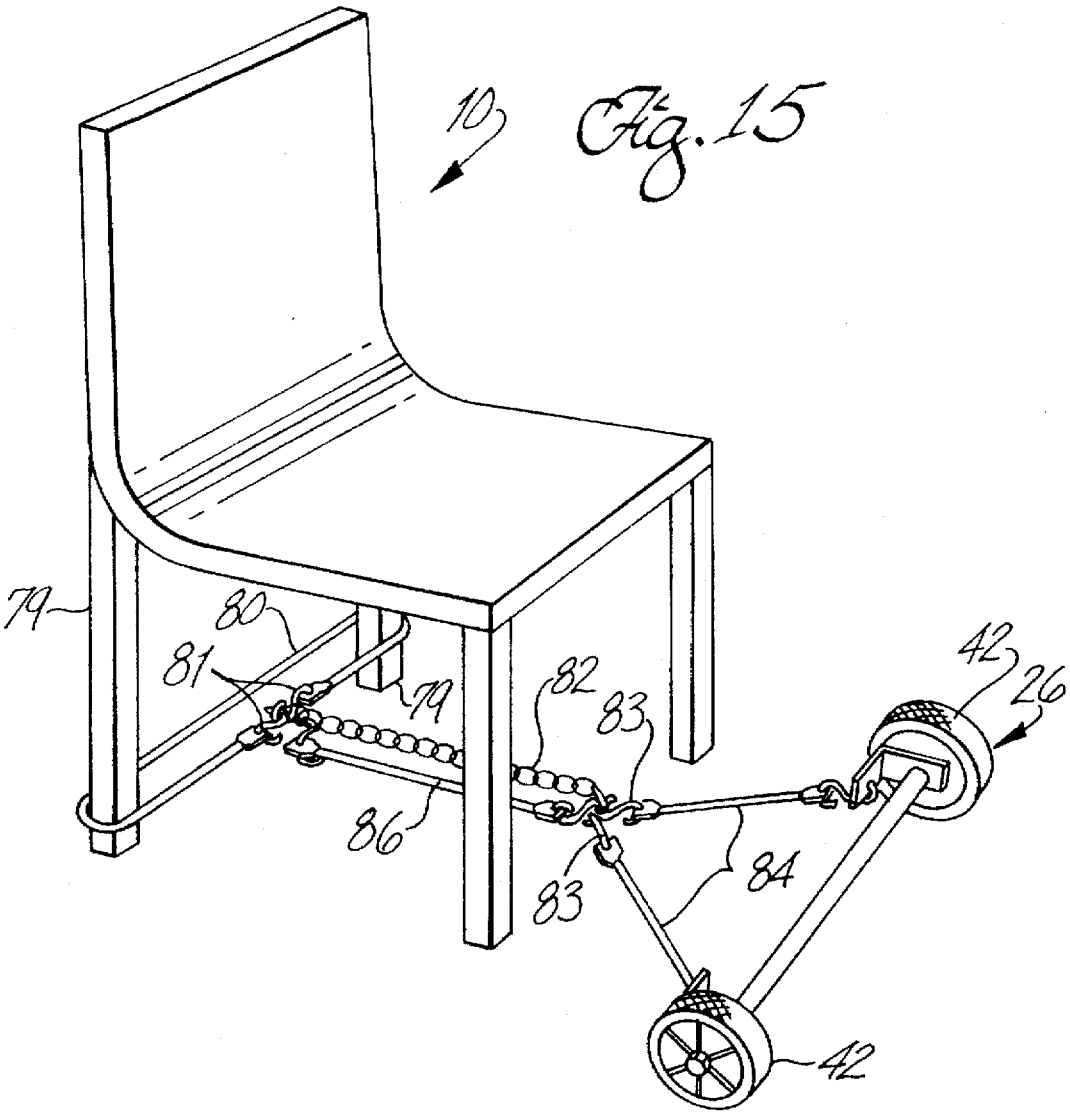
FIG. 15 is a perspective view of still another alternate exercise apparatus according to the present invention attached to the read legs of a multiple leg chair.

A still further alternate embodiment is illustrated in FIG. 15. The apparatus is attached to the back legs 79 of the multiple leg chair 10 with a connecting rubber strap 80 that is similar to the previously discussed exercise resilient members but longer. The connecting strap 80 is wrapped around both back legs of the chair and its ends hooked together with two S-hooks 81, one connected to each end of connecting strap 80. Because the connecting strap is in tension around the back chair legs, the connecting strap is held at a fixed position above the floor. One end of a chain 82 is hooked to S-hooks 81, and two exercising resilient members 84 are hooked with S-hooks 83 to the other end of the chain. The exercise resilient members 84 are attached to the foot support assembly as described above for FIGS. 1 and 3. This alternate embodiment allows the entire foot support apparatus to be pulled tightly against the front legs of the chair or stored under the chair when not in use. To this end, retraction resilient member 86 is attached in parallel to the chain between S-hooks 81 and 83 to retract and hold the foot support apparatus against the front edges of the chair or under the chair. Though the more elastic retraction resilient member is in series with the exercising resilient members, the retraction resilient member does not reduce the force necessary to extend the apparatus away from the chair because the chain defines a maximum extension length for the retraction member. After the chain and retraction resilient member are fully extended, the less elastic exercising resilient members and connecting strap must be stretched to push the apparatus away from the chair.

Figure 16:
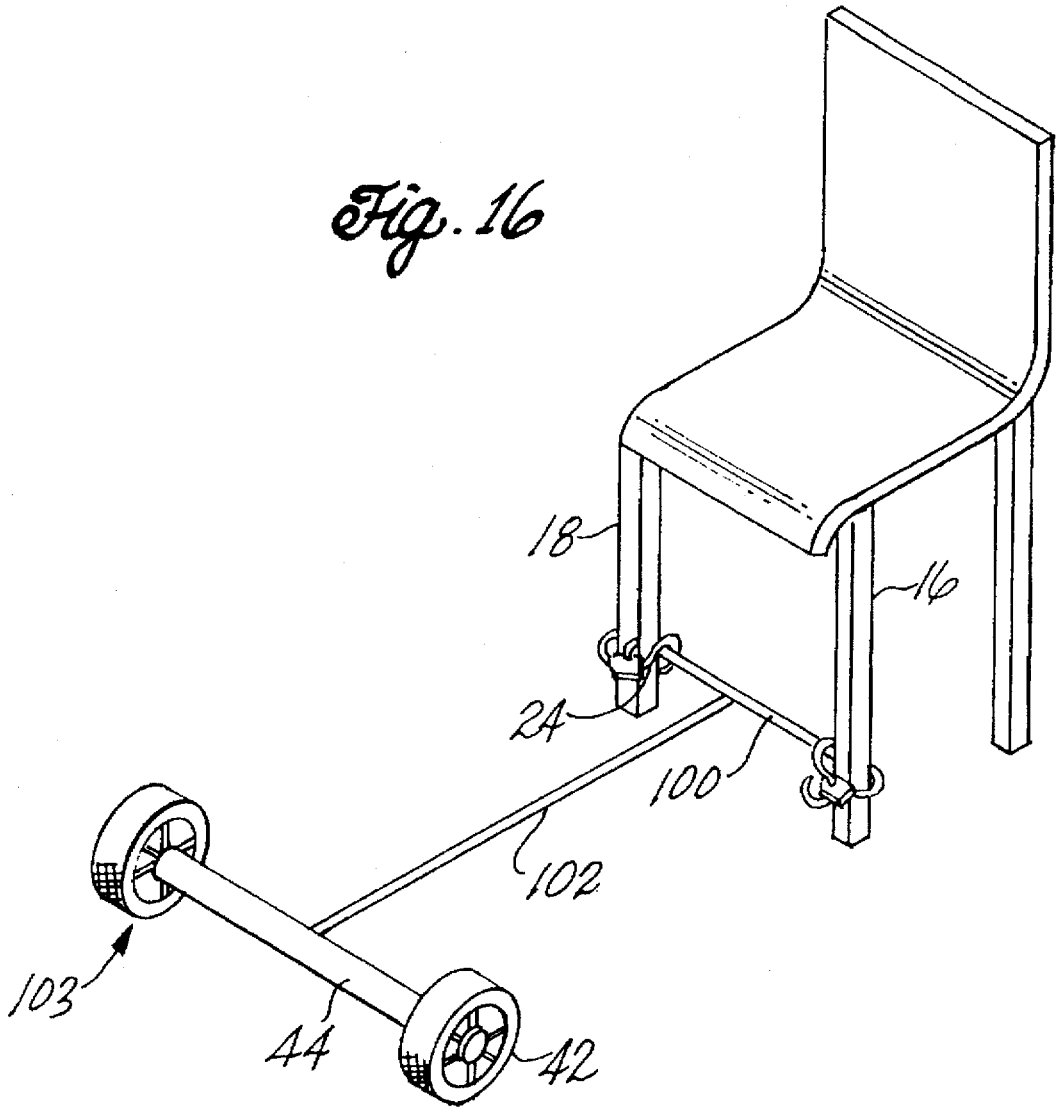
FIG. 16 is a perspective view of an alternate embodiment of the exercise apparatus of FIG. 2 utilizing a single exercising resilient member.

Another alternate embodiment is illustrated in FIG. 16. In this embodiment of the exercise apparatus a mounting resilient member 100 is attached to the front legs of a multiple leg chair. Each end of the mounting resilient member is wrapped around one front leg of the chair and hooked back onto the mounting resilient member. A single exercising resilient member 102 has one end centrally connected to the mounting resilient member and the other end centrally connected to the foot support assembly 103 with an eyelet and S-Hook arrangement not shown.

Figure 17:
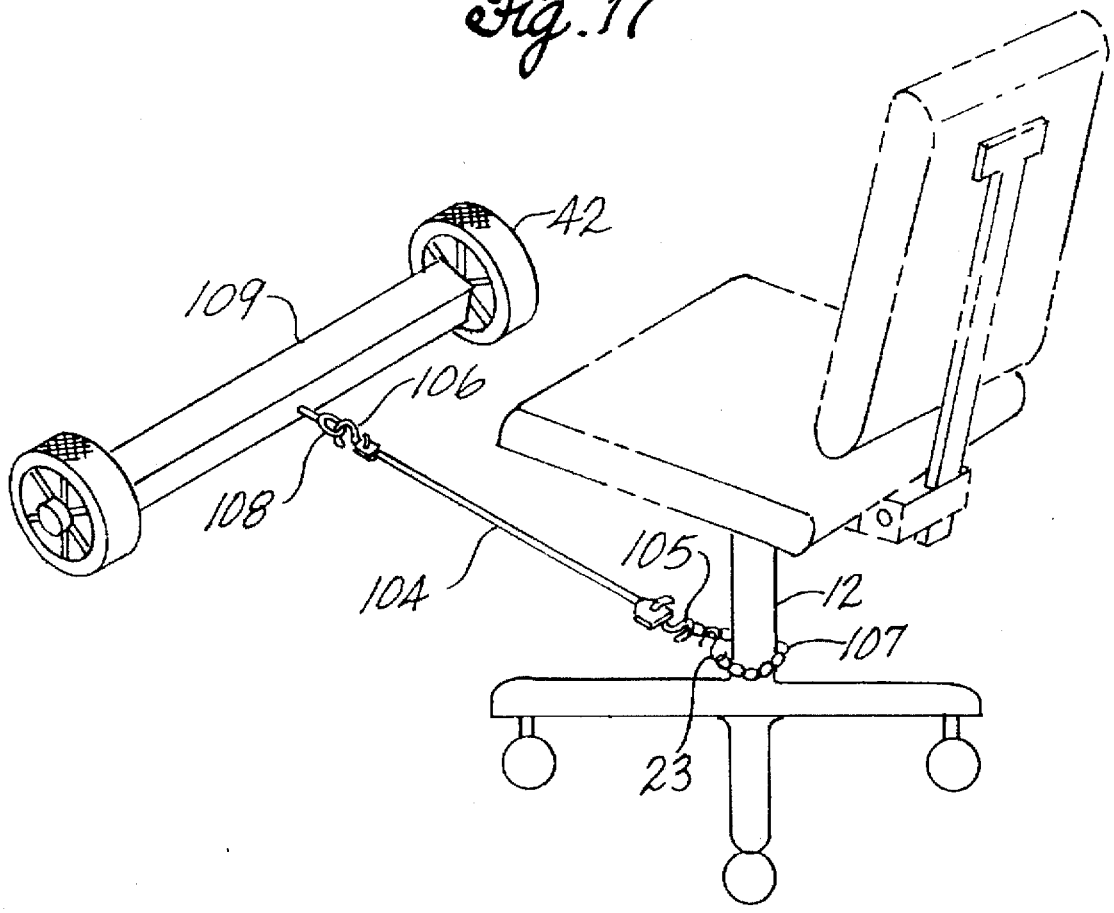
FIG. 17 is a perspective view of an alternate embodiment of the exercise apparatus of FIG. 3 utilizing a single exercising resilient member.

Still another alternate embodiment is shown in FIG. 17. In this embodiment, a single resilient member 104 is attached at one end with an S-Hook 105 to chain 107 and the other end of the resilient member is attached to the foot support assembly with S-Hook 106 which is hooked onto eyelet 108. The eyelet 108 is threaded into the foot support bar 109 at a central location on the bar.

Figure 18:
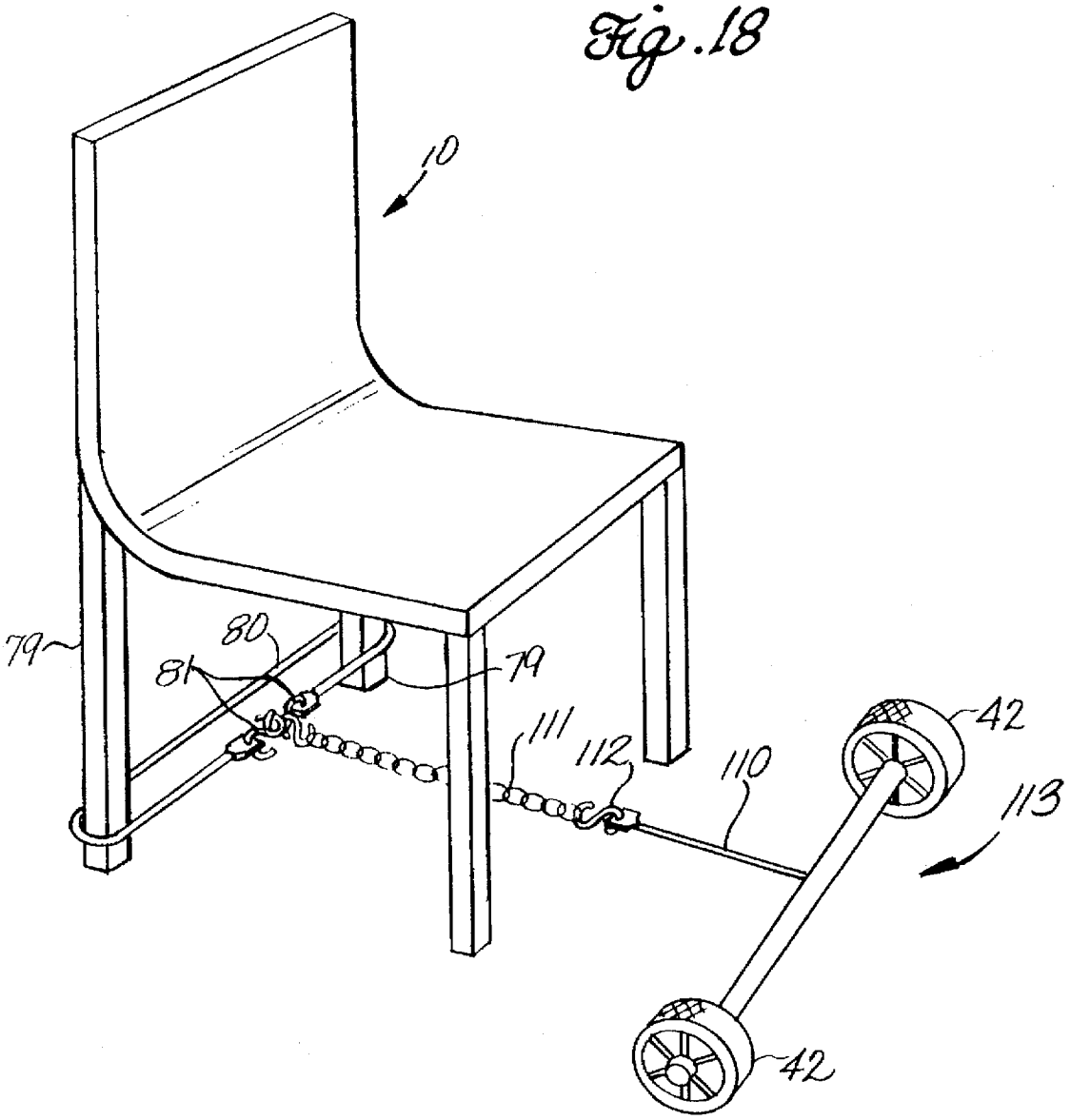
FIG. 18 is a perspective view of an alternate embodiment of the exercise apparatus of FIG. 15 utilizing a single exercising resilient member.

FIG. 18 is still another alternate embodiment of the exercising apparatus. The embodiment shown in FIG. 8 utilizes a single exercising resilient member 110 which replaces the two exercising resilient members of FIG. 15. One end of the exercising resilient member is attached to chain 111 with S-Hook 112, and the other end of the single exercising resilient member is attached to the foot support assembly 113 with the S-Hook and eyelet arrangement discussed above but not shown in FIG. 18.

The S-Hook eyelet arrangement shown in FIG. 17 has a minor disadvantage in that it may restrict the angle at which the support bar 109 can function thereby restricting the angle between the user's feet and legs at which the occupant may exercise. To overcome this restriction a bearing assembly is mounted onto the foot support bar 115 as shown in FIG. 19. The bearing assembly, shown in detail in FIG. 20, has an outer race 114 with an eyelet 116 welded thereto. The resilient members (not shown) are attached to the eyelet with S-hooks (not shown). Ball bearings 118 allow the outer race to rotate relative to inner race 120. The inner race has an aperture 122 there through for receiving the foot support bar. The aperture of 122 shown in FIG. 20 is square but can be modified to match the shapes of other foot support bars such as rectangular.

Figure 22:
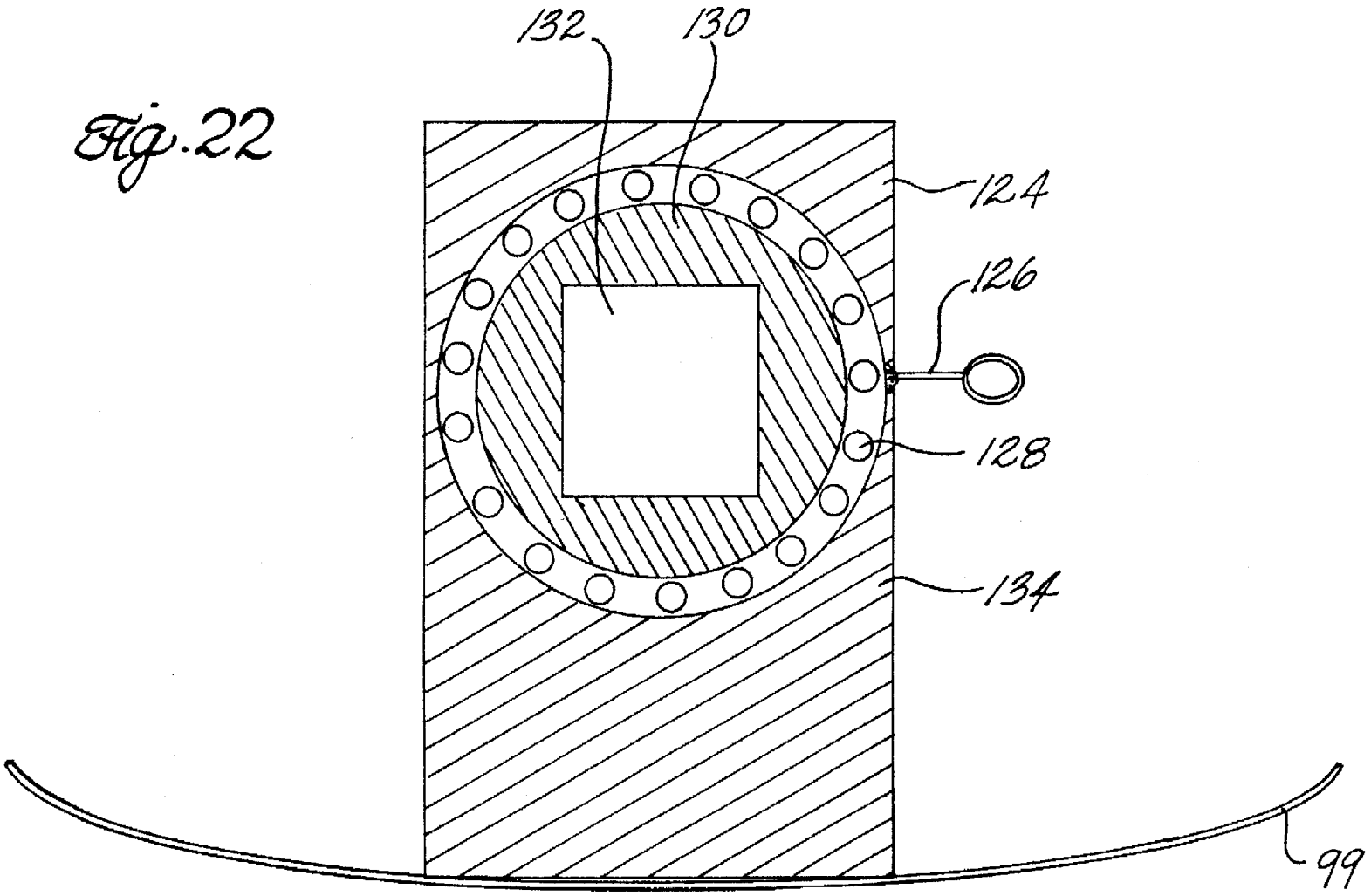
FIG. 22 is a side view of the alternate embodiment of the foot assembly of FIG. 21 illustrating a bearing assembly connection.

FIG. 22 illustrates the ball bearing assembly used for the glider embodiment of the foot support assembly shown in FIGS. 21 and 23. Again an outer race 124 has an eyelet 126 welded thereto. The eyelet 126 receives the S-Hook (not shown) from the exercising resilient member (not shown). Ball bearings 128 allow the outer race 124 to rotate relative to the inner race 130. The inner race has an aperture of 132 there through for receiving the foot support bar. The bearing assembly allows the occupant to maintain a comfortable angle between the legs and the feet while exercising.

The disclosed exercise apparatus provides an inexpensive way to exercise in a conventional chair while performing other tasks such as working on the computer, revising documents, opening mail, etc., and the wheel design of the exercise apparatus allows the support assembly to translate smoothly away from and back toward the chair, even while under a desk, while on any floor surface including carpet.

Thus, an exercise apparatus is disclosed which utilizes resilient members attached to a conventional office chair to more efficiently obtain desired exercise through out the typical workday while performing other work related tasks. While embodiments and applications of this invention have been shown and described, it would be apparent to those skilled in the art that many more modifications are possible without departing from the inventive concepts herein. It is, therefore, to be understood that within the scope of the appended claims, this invention may be practiced otherwise than as specifically described.

What is claimed is:

1. Exercise apparatus for attachment to conventional chairs having a central support post or multiple leg support comprising:

a foot support consisting of a bar having a length, first and second ends and at least one edge extending substantially along the length of the bar, against which the heel of a shoe can lock;

a resilient member for operatively connecting the chair and the foot support;

at least one wheel mounted on each of the respective ends of the foot support for rolling directly on a floor;

at least one attachment means rotatably mounted on the foot support;

the resilient member being attached to the attachment means; and the at least one attachment means, the foot support, and the wheels rotate independently about a common longitudinal axis.

2. The exercise apparatus according to claim 1 wherein the foot support comprises a bar having four edges extending substantially over a length of the foot support.

3. The exercise apparatus according to claim 1 wherein the means for attachment comprises a plurality of L-brackets attaching the resilient members to the foot support.

4. The exercise apparatus of claim 1, additionally comprising means for attaching the resistant member to a central support post.

5. The exercise apparatus of claim 1, in which the resilient member comprises first and second straps extending between the bar near its respective ends at an angle upwardly and inwardly toward the post.

6. The exercise apparatus of claim 5, in which the at least one attachment means attaches the first and second straps to the bar such that the first and second straps can pivot horizontally and vertically with respect to the bar.

7. The exercise apparatus of claim 6, additionally comprising means for attaching the first and second straps to the post near the top of the post so the angle changes as the bar moves toward and away from the chair.

8. The exercise apparatus of claim 7, in which the resilient member additionally comprises third and fourth straps that extend horizontally from the bar near its respective ends.

9. The exercise apparatus of claim 8, additionally comprising means for attaching the third and fourth straps to the post near the bottom of the post.

10. The exercise apparatus of claim 9, in which the at least one attachment means attaches the third and fourth straps to the bar such that the third and fourth straps can pivot horizontally and vertically with respect to the bar.

11. The exercise apparatus of claim 2, in which the resilient member comprises first and second straps extending between the bar near its respective ends at an angle upwardly and inwardly toward the post.

12. The exercise apparatus of claim 11, in which the at least one attachment means attaches the first and second straps to the bar such that the first and second straps can pivot horizontally and vertically with respect to the bar.

13. The exercise apparatus of claim 12, additionally comprising means for attaching the first and second straps to the post near the top of the post so the angle changes as the bar moves toward and away from the chair.

14. The exercise apparatus of claim 13, in which the resilient member additionally comprises third and fourth straps that extend horizontally from the bar near its respective ends.

15. The exercise apparatus of claim 14, additionally comprising means for attaching the third and fourth straps to the post near the bottom of the post.

16. The exercise apparatus of claim 15, in which the at least one attachment means attaches the third and fourth straps to the bar such that the third and fourth straps can pivot horizontally and vertically with respect to the bar.

17. The exercise apparatus of claim 8, in which the third and fourth straps require substantially less force to deform than the first and second straps.

18. The exercise apparatus of claim 17, in which the third and fourth straps are substantially shorter than the first and second straps.

19. The exercise apparatus of claim 8, in which the third and fourth straps are substantially shorter than the first and second straps.

20. The exercise apparatus of claim 10, in which the third and fourth straps require substantially less force to deform than the first and second straps.

21. The exercise apparatus of claim 20, in which the third and fourth straps are substantially shorter than the first and second straps.

22. The exercise apparatus of claim 21, in which the at least one attachment means comprises an axle for mounting each wheel on the bar and an L-bracket mounted on each axle to connect the first, second, third, and fourth straps to the wheels and the bar.

23. The exercise apparatus of claim 1, additionally comprising means for attaching the resilient member to a central support post.

* * * * *